US006384350B1

(12) United States Patent
Shincovich et al.

(10) Patent No.: US 6,384,350 B1
(45) Date of Patent: May 7, 2002

(54) METER TEST SWITCH

(75) Inventors: John T. Shincovich, North Canton; Thomas J. Archer, Canton, both of OH (US)

(73) Assignee: Meter Devices Company, Canton, OH (US)

( * ) Notice: Subject to any disclaimer, the term of this patent is extended or adjusted under 35 U.S.C. 154(b) by 0 days.

(21) Appl. No.: 09/620,261

(22) Filed: Jul. 19, 2000

Related U.S. Application Data

(60) Provisional application No. 60/146,681, filed on Aug. 2, 1999.

(51) Int. Cl.[7] ..... H01H 9/26
(52) U.S. Cl. ..... 200/5 A; 439/517
(58) Field of Search ..... 200/15, 50.33, 200/50.35, 307; 439/517

(56) References Cited

U.S. PATENT DOCUMENTS

| | | | | |
|---|---|---|---|---|
| 1,836,951 A | | 12/1931 | Blakeslee | |
| 1,891,212 A | | 12/1932 | Blakeslee | |
| 2,030,799 A | | 2/1936 | Parsons | |
| 2,249,977 A | | 7/1941 | Penfold | |
| 2,271,588 A | | 2/1942 | Hecht et al. | |
| 2,534,449 A | * | 12/1950 | Johansson | 175/220 |
| 3,171,939 A | | 3/1965 | Ustin | |
| 3,662,323 A | * | 5/1972 | Stanback | 339/198 M |
| 4,115,669 A | | 9/1978 | Cali | 200/331 |
| 4,150,271 A | | 4/1979 | McMillen | 200/153 |
| 4,160,889 A | | 7/1979 | Tognazzini et al. | 200/153 |
| 4,190,749 A | * | 2/1980 | Erickson et al. | 200/11 TW |
| 4,319,107 A | * | 3/1982 | Haskins | 200/303 |
| 4,356,368 A | * | 10/1982 | Osika | 200/307 |
| 4,590,387 A | * | 5/1986 | Yoshida et al. | 307/64 |
| 5,722,534 A | | 3/1998 | Wright | 200/305 |
| 5,945,650 A | * | 8/1999 | Holland et al. | 218/1 |
| 6,002,579 A | * | 12/1999 | Drexler et al. | 361/605 |
| 6,206,733 B1 | * | 3/2001 | Wu | 439/651 |

OTHER PUBLICATIONS

"Test Switches", MDI ©1999 Meter Devices Company, Inc.
"Testswitch, The New Safer Miniature Test Switch", TestSwitch, Patent #5722534 No date.

* cited by examiner

*Primary Examiner*—P. Austin Bradley
*Assistant Examiner*—Nhung Nguyen
(74) *Attorney, Agent, or Firm*—Young & Basile, PC

(57) ABSTRACT

A test switch apparatus for an electrical device includes identical modules each carrying at least one switch thereon and terminals coupled to the switch and receiving electrical conductors. Complimentary interconnecting members are formed on each base and opposed barrier walls of each module for releasably interconnecting two modules in a side-by-side arrangement. Lock elements are optionally formed on each module for locking two adjacent switch modules together, preferably after the two modules are substantially joined by the interconnected members. End pieces are interconnected by interconnecting members to endmost modules. A cover is releaseably attachable to the end pieces.

15 Claims, 4 Drawing Sheets

24
92
93
94
98
88
90
86
70
96
91
100
102
76
80
73
72
68
13
74
82
78
49
50
51
36
42
38
44
28
26
46
51
30
40
60
104
64
34
62
33
32
84

METER TEST SWITCH

CROSS REFERENCE TO CO-PENDING APPLICATION

This application claims to the benefit of the priority date of co-pending, provisional Patent Application Ser. No. 60/146,681 filed Aug. 2, 1999, the entire contents of which are incorporated herein by reference.

BACKGROUND OF THE INVENTION

1. Field of the Invention

The present invention relates, in general, to power disconnect switches and, specifically, to test switches and, even more specifically, to watthour meter test switches.

2. Description of the Related Art

Power disconnect switches are used in a number of applications, such as watthour meter, relay, instrument transducer and control system calibration, disconnecting, troubleshooting and testing.

In the electric utility application, watthour meters are commonly employed to measure electrical power consumption at a residential or commercial establishment. A cabinet is typically mounted on an outside wall of the residence or building and contains a meter socket having pairs of line and load contacts which are connected to electric power line conductors extending from the utility power network and electric load conductors connected to the residential or building establishment power distribution network. The contacts in the socket receive blade terminals on a plug-in watthour meter to complete an electric circuit through the meter between the line and load terminals in the cabinet for the measurement of electrical power consumption.

Current transformer or CT rated watthour meters and socket adapters are employed in high current applications. In such an application, current transformers are coupled to the line and load conductors and have their output leads connected to terminals in a current transformer or CT rated watthour meter socket adapter. A low current rated watthour meter is then plugged into the socket adapter or socket to measure consumed at the building site.

In addition, potential coils in a watthour meter may also be connected by potential blade terminals to potential blade contacts mounted in the socket or socket adapter and connected by individual conductors to terminals mounted in the terminal portion of the socket adapter.

However, with current transformer rated socket adapters or sockets, it is necessary to short circuit the line and load terminals when the watthour meter is removed from the socket for replacement or testing. Heretofore, test switch devices have been incorporated into the CT rated socket to provide the necessary short circuit or bypass feature.

Exemplary test switches are made by Meter Devices Company, Inc., of Canton, Ohio, the assignee of the present invention. Such test switches are typically mounted in a watthour meter socket immediately below a watthour meter or watthour meter/socket adapter. The test switches are generally in the form of single throw, knife-type switches which are provided in multiples ganged together into one assembly; but each electrically connected between one line contact and one load contact in the socket. Once an optional socket cover is removed, the test switches can be operated as desired to provide the necessary bypass connection between the line and load contacts and conductors prior to removing the watthour meter from the socket for testing, recalibration, replacement, etc.

However, while such test switches have proven to be an effective means for implementing a watthour meter bypass connection, such test switches are not without their drawbacks. Typically, each test switch is formed as a one-piece unit or member, with the electrical contact and terminals mounted on an electrically insulating base. Separate insulating barriers are provided between two adjacent test switches to provide electrical isolation between the connections on two adjacent test switches. Further, such test switches, in one typical mounting arrangement, are secured to a base plate by means of mechanical fasteners, snap-in connections, etc. In another mounting arrangement, apertures are formed in each insulating base and the intervening insulating plates receive elongated, threaded rods to secure the plurality of test switches and insulating plates in a fixed, longitudinal arrangement.

Both mounting arrangements involve many time consuming assembly steps due to the need to separately mount each test switch base to an underlying mounting plate or to align the test switches for receiving the elongated threaded rods there through.

Thus, it would be desirable to provide a test switch apparatus which has a simplified construction for a reduced manufacturing cost. It would also be desirable to provide a test switch apparatus which can be formed of individual identical switch modules re-arrangable in any mounting pattern. It would also be desirable to provide a test switch apparatus having reduced part count.

SUMMARY

The present invention is a test switch apparatus which includes a plurality of individually operable switch members, each including a separately actuatable switch or contact capable of opening and closing an electrical circuit between two conductors attached to terminals on the switch member.

In one aspect of the invention, the test switch apparatus includes a plurality of identical modules, each having a base and a planar barrier wall extending from the base. The base has a first sidewall opposed from the barrier wall. Complimentary interconnecting members are formed on the base and the barrier wall for releaseably interconnecting two modules in a side-by-side arrangement. The switch and terminals are mounted on an upper wall of the base between opposed sidewalls.

In one aspect of the invention, the interconnecting members comprise at least one recess formed on one of the sidewalls of the base and the barrier wall and at least one complimentary shaped projection formed on the other of the barrier wall and the first sidewall of the base. In another aspect, two spaced recesses and two spaced mating projections are formed on the barrier wall and the first sidewall of the base.

Lock elements are also optionally formed on each barrier wall and each base for lockingly interconnecting two adjacent switch modules. The lock elements preferably comprise complimentary lock elements formed on the first sidewall of the base and the barrier wall. More preferably, the lock elements interlock after adjacent modules are substantially interconnected by the interconnecting members.

In one aspect of the invention, the lock elements include a projection extending outward from one of the first sidewalls in the base and the barrier wall and a complimentary-shaped recess formed in the other of the barrier wall and the first sidewall of the base.

In another aspect of the invention, at least one end piece is mounted adjacent to an endmost switch module. The end piece includes a planar barrier wall and at least one interconnecting member releasably interconnectible with a mating interconnecting member on the adjacent endmost switch module. The one end piece also includes a base having a first sidewall and an opposed barrier wall with the first portion of the barrier wall contiguous with and extending from the base.

At least one lock projection and one lock receiver are preferably formed on the one end piece and are releaseably interlockable with a complimentary lock projection and lock receiver on the adjacent endmost switch module.

The test switch apparatus of the present invention has significant advantages compared with previously devised test switches, particularly those used in watt-hour meter sockets. The present test switch apparatus is formed of a number of individual, identical switch modules which are rearrangeable in any mounting pattern. This reduces the number of different components required for a typical switch assembly which may incorporate ten or more individual switches. The test switch apparatus of the present invention is also easy to assemble and that it does not require alignment of all the switch modules for the insertion of through rods in aligned bores at opposite ends of all of the switch modules. The interconnecting members and optional lock elements are easily engageable to assemble the test switch apparatus.

BRIEF DESCRIPTION OF THE DRAWING

The various features, advantages and other uses of the present invention will become more apparent by referring to following detailed description and drawing in which.

DETAILED DESCRIPTION

Figure 1:
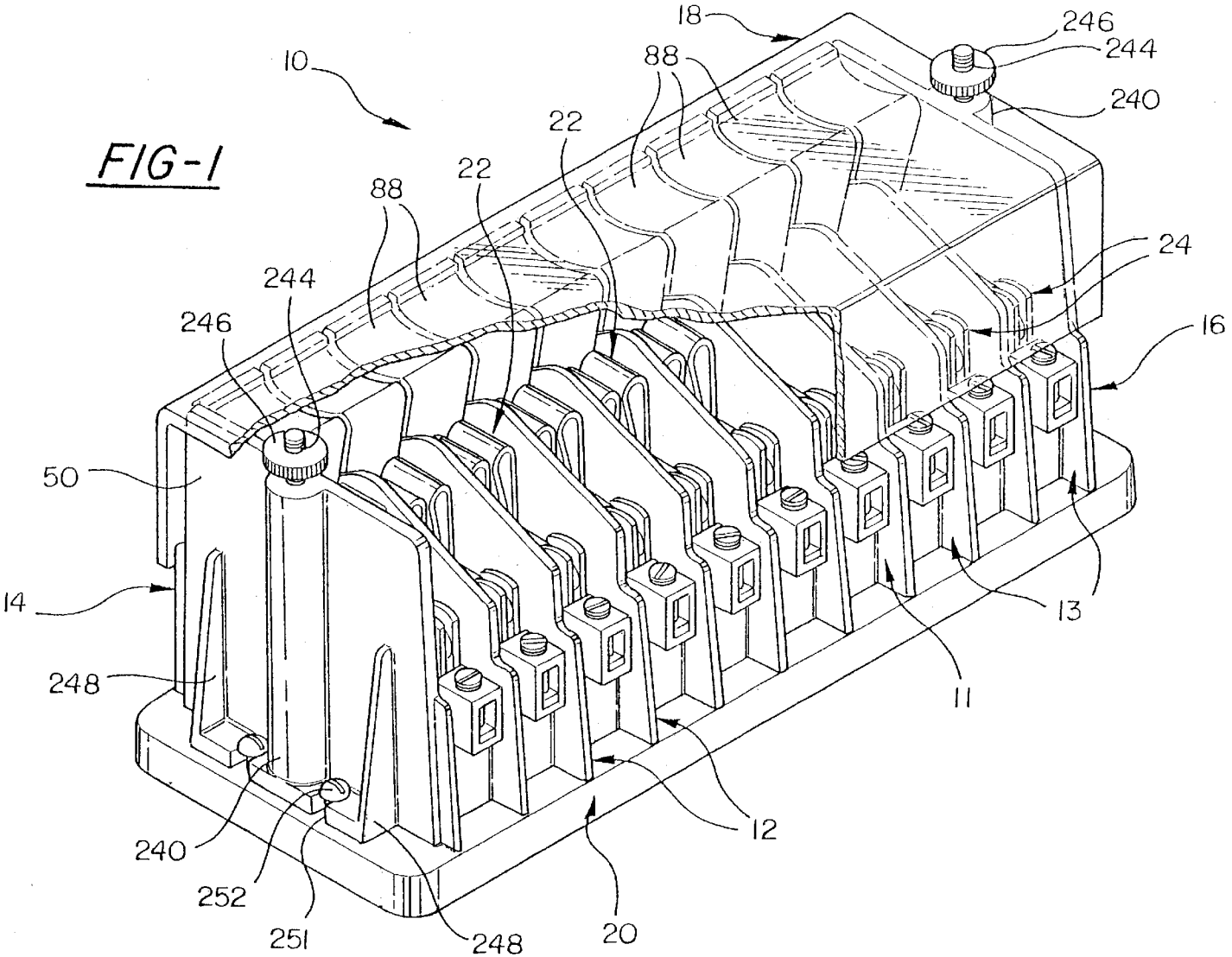
FIG. 1 is a perspective view of a test switch apparatus constructed in accordance with the teachings of the present invention.

Referring now to the drawing, and to FIG. 1 in particular, there is depicted a test switch apparatus 10 constructed in accordance with the teachings of the present invention. The apparatus 10 includes a plurality of individually operable switch modules, each of which includes a separately actuatable switch or contact capable of opening and closing an electrical circuit between two conductors attached to terminals on the switch module.

Although the following example of the test switch apparatus 10 is described in conjunction with an electrical watthour meter socket and, more particularly, a current transformer rated socket wherein individual connections to certain of the switch modules are made to current transformers coupled to line and load conductors extending from the socket, it will be understood that the test switch apparatus 10 of the present invention may be employed in numerous other applications including, for example, relay, instrument transducer and control system calibration, disconnecting, troubleshooting and testing.

Further, in the specific watthour meter socket application described and illustrated hereafter, the test switch apparatus 10 is depicted in a three-phase configuration including six switch modules arranged in three pairs for the three phase current connections, three switch modules for the three-phase potential connections and one switch module for the neutral or ground connection. Other test switch configurations, including test switches arranged for only a single phase socket application, may also be constructed in accordance with the present invention.

As shown in FIG. 1, the test switch module 10 includes at least one neutral switch module 11, a plurality of current switch modules 12, and a plurality of potential switch modules 13 arranged side-by-side and interconnected together as described hereafter. First and second end pieces 14 and 16 are interconnected to the endmost switch modules. An optional cover 18 is removably attached to the end pieces 14 and 16. Similarly, an optional mounting adapter 20 is securable to the end pieces 14 and 16 to provide a common mounting hole pattern to mount the test switch apparatus 10 to an existing support surface, such as a support surface in a watthour meter socket.

Referring now to the drawings, and to FIGS. 1–7 in particular, the test switch apparatus 10 includes a plurality of substantially identical switch modules 11, 12 and 13. Each module 11, 12 and 13 is formed of an electrically insulating material, such as a plastic material. GE Lexan 940 is used in a preferred example of the invention.

Figure 2:
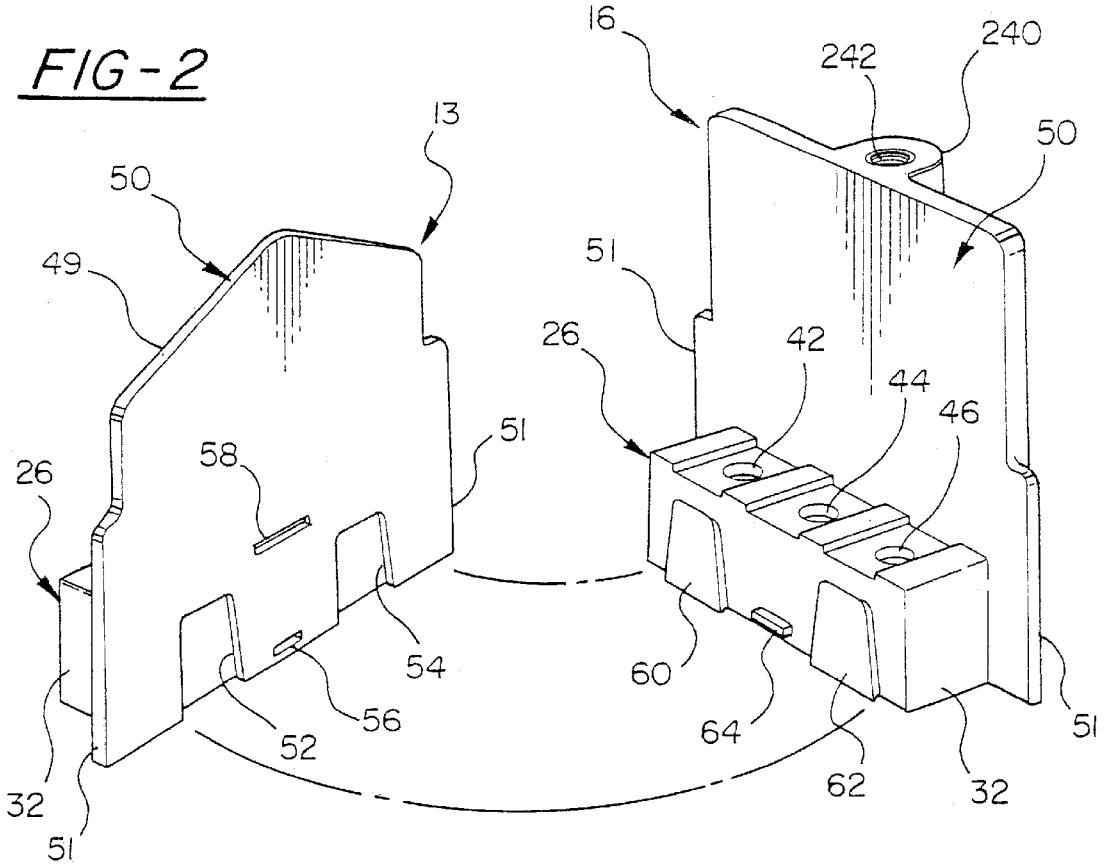
FIG. 2 is an exploded, perspective view of the right end piece and right endmost switch module shown in FIG. 1.
Figure 3:
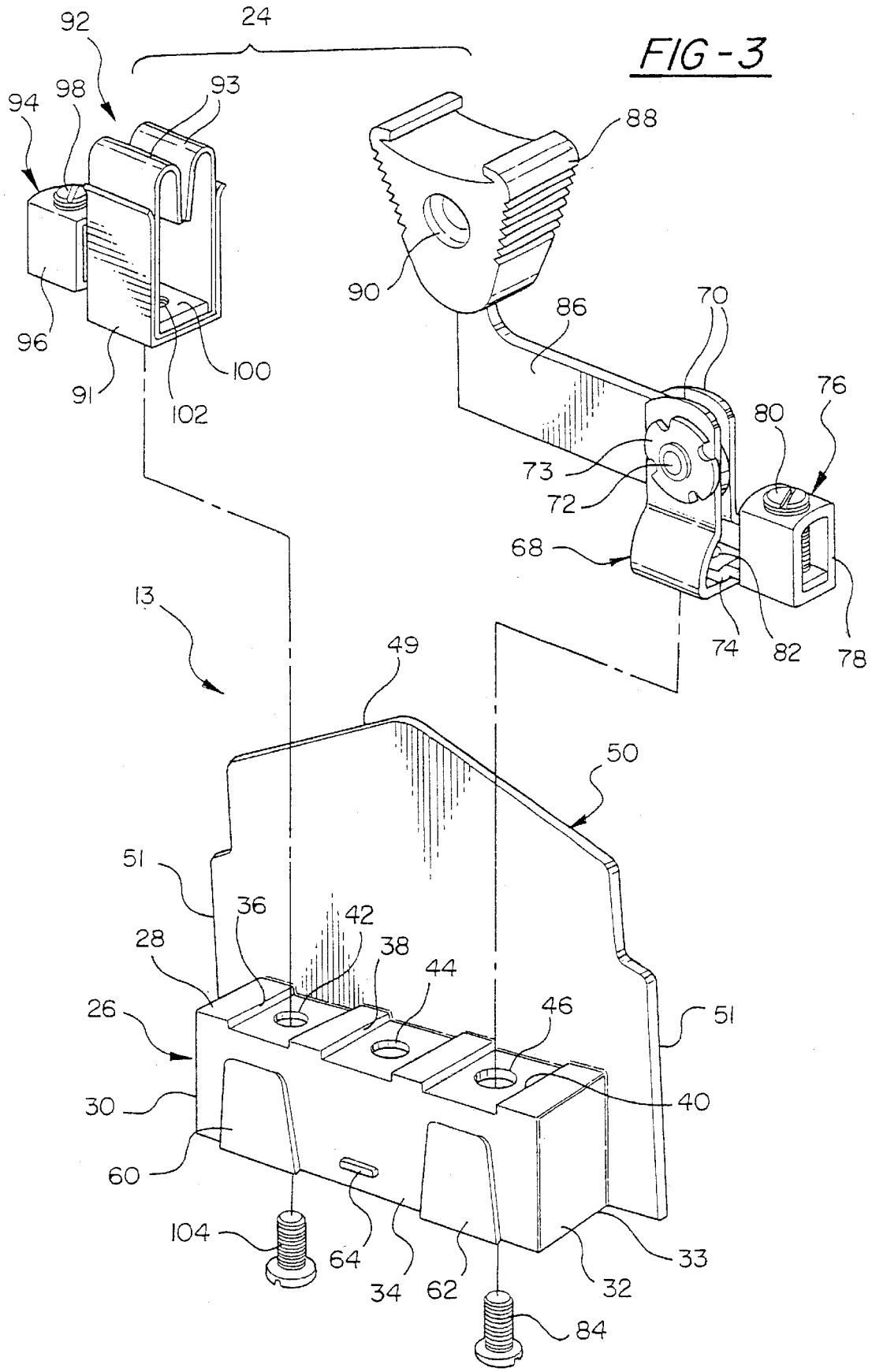
FIG. 3 is an exploded, perspective view showing the construction of one current test switch shown in FIG. 1.

As shown in FIGS. 2 and 3, each switch module 11, 12 and 13 includes a base 26 having a generally polygonal or rectangular shape. The base 26 is formed of a top surface 28, opposed end walls 30 and 32, a bottom surface 33 and an outer side wall 34. A plurality of recesses 36, 38 and 40 are formed in the top and are substantially equidistantly spaced between the opposed end walls 30 and 32. A bore 40, 42 and 44 extends from each recess 36, 38 and 40 through the base 26 to the bottom surface 33.

The side wall of the base 26 opposite from the outer side wall 34 is unitarily formed as an elongated, thin electrically insulating barrier 50. The barrier 50 has a top edge 49 projecting substantially above the top surface 28 of the base 26. Likewise, opposed side edges 51 of the barrier 50 project outwardly from the end walls 30 and 32 of the base 26.

Interconnecting members are formed on the outer side wall 34 of the base 26 as well as on the lower portion of the barrier 50 on each switch module 11, 12 and 13. The interconnecting members may comprise at least one and preferably two or even three or more mating projections and recesses formed as complementary tongue and grooves, for example, for slidably interconnecting two adjacent disposed switch modules 11, 12 or 13. Thus, it will be understood that the following description of two interconnecting members on each side edge of each switch module and end pieces will be understood to be by example only.

As shown in FIGS. 2 and 3, a first pair of interconnecting members 52 and 54 are formed on the lower portion of the barrier 50 and face outwardly from the barrier 50 away from the base 26. A second pair of interconnecting members 60 and 62 is formed on the opposite side wall 34 of the base 26 and likewise project outwardly from the side wall 34.

In one aspect of the present invention, the first interconnecting members 52 and 54 are in the form of recessed grooves in the lower portion of the barrier 50. The interconnecting members 52 and 54 have inwardly tapering side edges extending from the bottom surface 33 to a closed end. The second pair of interconnecting members 60 and 62 are in the form of outwardly extending projections having a shape complementary to the shape of the recesses 52 and 54.

It will be understood that the first interconnecting members 52 and 54 could likewise be formed as projections extending outwardly from the barrier 50 and the second pair of interconnecting members 60 and 62 on the side edge 34 could be formed as inwardly extending recesses.

In order to interconnect two adjacent disposed switch modules or end pieces of the test switch apparatus 10, such as the switch module 13 and the end piece 16, the two adjacent switch modules and/or end piece are arranged one slightly above the other to align the second interconnecting member 60 and 62 with the first interconnecting members 52 and 54 and allowing the sliding interconnection of the first and second pairs of interconnecting members 52 and 54, and 60 and 62. The projections 60 and 62 slide into the recesses 52 and 54 until the upper ends of the projections 60 and 62 abut the inner, closed ends of the recesses 52 and 54.

At the same time, in another aspect of the present invention, each switch module 11, 12 and 13 as well as the end pieces 14 and 16 are provided with lock means for lockingly connecting two adjacent switch modules or one switch module and one end piece together. In a preferred embodiment, the lock means comprises a lock projection or arm 64 extending outward from the side edge 34 of the base 26 of each module 11, 12 and 13. A lock arm receiver 56 is formed in the lower portion of the barrier 50 of each switch module 11, 12 and 13 generally between the recesses 52 and 54. The projection 64 and/or the receiver 56 have tapering side edges along their vertical extent to allow the sliding engagement and forced release of two switch modules and/or one switch module and one end piece together. Thus, as two adjacent switch modules 11, 12, 13 or the end pieces 14 and 16 are joined together by sliding interconnection of the first and second pairs of interconnecting members 52 and 54, and 60 and 62, two adjacent members will slide together until the bottom edge of one module abuts the lock arm 64 of an adjacent module or end piece. Additional force must then be applied to the two modules or to the module and end piece to cause the bottom portion of one module to slide over the projection 64 until the projection 64 seats within the lock arm receiver 56 forcibly locking the two adjacent modules or end piece together in a snap connection.

Figure 4:
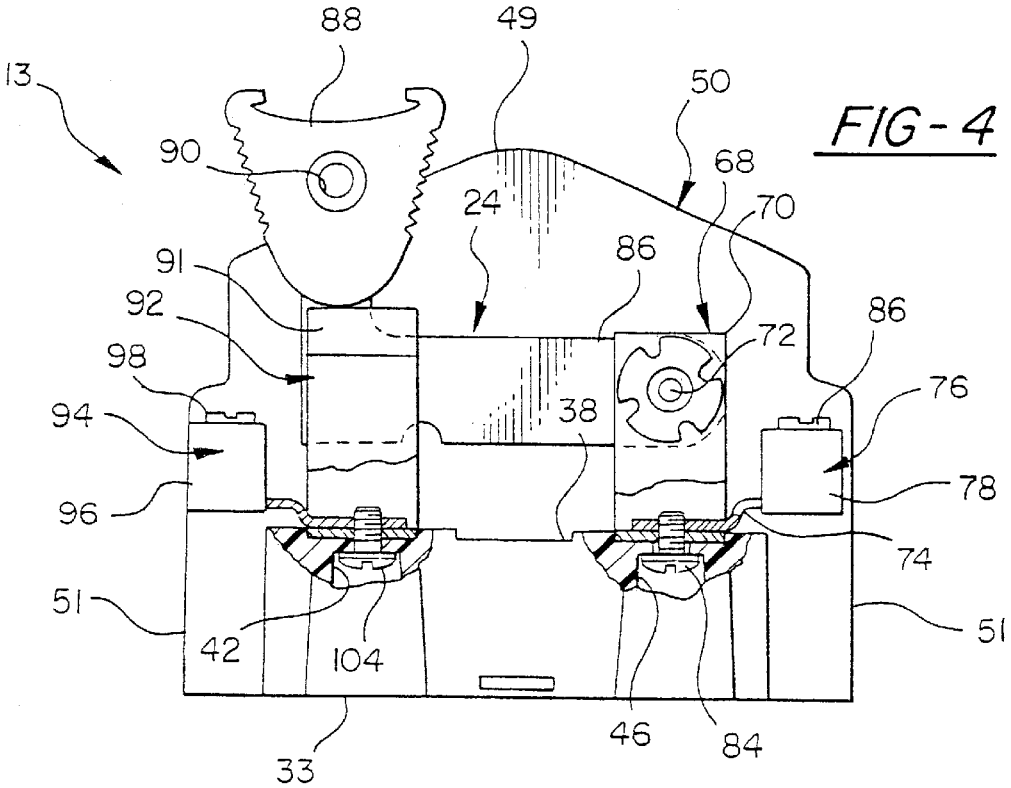
FIG. 4 is a side elevational view of the assembled test switch shown in FIG. 3 depicted in the closed contact position.

Referring now to FIGS. 1, 3 and 4, each of the potential and neutral switch modules 11 and 13 carries one test switch or test contact 24. Each test switch 24 includes a hinge jaw assembly 68 having a pair of spaced legs 70 extending from a common base. A brass rivet 72 extends through the legs 70 and acts as a pivot. A compression spring or Belleville washer 73 is mounted over the rivet 72 to maintain correct adjusted jaw tension. An electrically conductive tongue 74 extends into a cavity formed between the legs 70 and the base of the hinge jaw assembly 68. The other end of the tongue 74 is mounted in a terminal 76 having a hollow collar. A threaded fastener 80 projects through an aperture in the collar 78 to securely connect the tongue 74 to an external conductor, not shown, such as a conductor connected to a meter socket terminal or a current transformer lead.

A switch or knife blade 86 is pivotally mounted at one end to the hinge jaw assembly 68 and is movable between first and second positions about the pivot 72. An insulated or plastic handle 88 is mounted on the opposite end of the knife blade 86. An aperture 90 in the handle 88 is alignable with apertures in adjacent handles 88 of adjacent test switches for receiving a gang bar for actuation of like test switches in one pivotal operation.

An intermediate portion of the knife blade 86 engages a jaw contact 92 having a pair of spaced, inward turned, resilient legs 93 projecting from a common base. A U-shaped spring 91 surrounds the jaw contact 92 to ensure positive contact between the jaw contact 92 and the knife blade 86.

A tongue 100 has one end mounted internally within the jaw contact 92. An opposite end of the tongue 100 is mounted in a collar 96 of a terminal 94. A threaded fastener 98 projects through a collar 96 forming the terminal 94 to securely connect an external conductor extending from the socket or a current transformer, not shown, with the opposite end of the tongue 100.

The tongue 74 has an aperture 82 alignable with a like aperture in the base of the hinge jaw assembly 68. When the hinge jaw 68 is mounted in the recess 40, the apertures are in alignment with the bore 44 for receiving a fastener, such as a threaded screw 84, inserted inwardly through the bottom of the bore 42 in the base 26 to secure the hinge jaw assembly 68 and the tongue 74 to the base 26. Similarly, the tongue 100 has an aperture 102 alignable with like apertures in the jaw contact 92 and the spring 91. The jaw contact 92 is mountable in the recess 36 in the base 26 of one module 13 with the apertures, including aperture 102, aligned with the bore 42 in the recess 36. A fastener 104 inserted inwardly through the bottom end of the bore 42 securely mounts the jaw contact 92 to the base 26.

In operation, the knife blade 86 is movably disposed in a first, closed position shown in FIG. 4 wherein an intermediate portion of the knife blade 86 contacts the contact jaw 92 thereby completing a circuit through the switch 24 between the electrical conductor connected to the terminal 94 and the electrical conductor connected to the terminal 76. However, when it is necessary to disconnect or open the circuit, pivotal movement of the handle 88 will disengage the knife blade 86 from the jaw contact 92. The spring force provided by the compression spring 73 on the hinge jaw assembly 68 will maintain the knife blade 86 in the open position spaced from the jaw contact 92.

Figure 5:
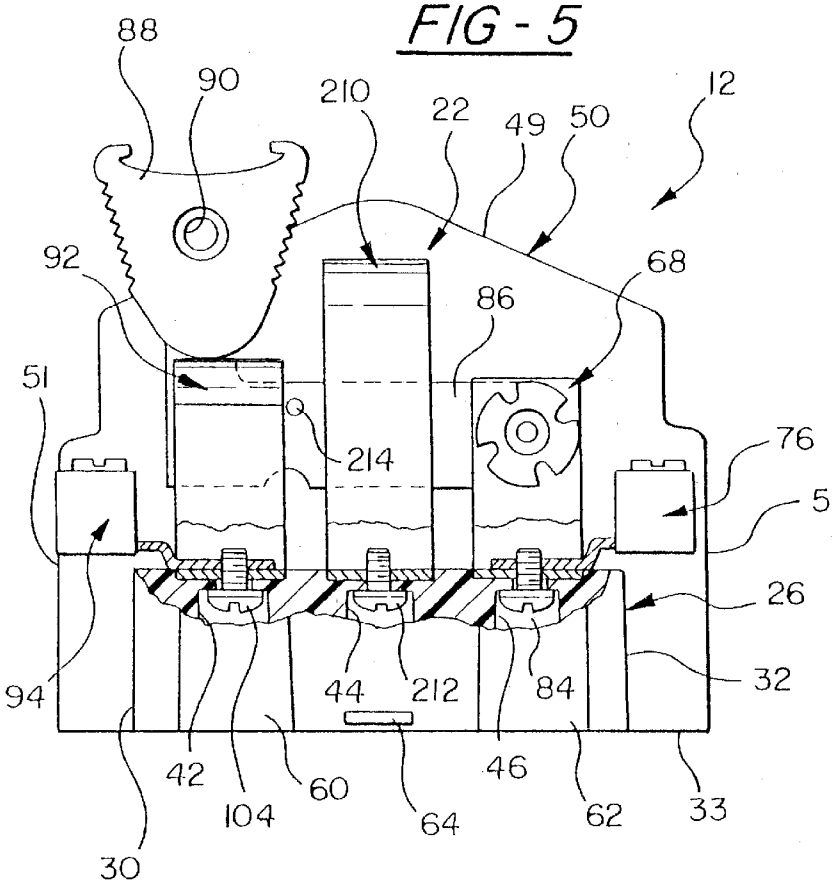
FIG. 5 is a side elevational view of a potential test switch shown in FIG. 1.

FIG. 5 depicts a current switch or contact 22 mounted on one of the switch modules 12. The current switch 22 is substantially identical to the potential switch 24 in that a knife blade 86 is pivotally mounted at one end to a hinge jaw assembly 68 which is secured by a fastener 84 to the base 26 of the switch module 12. Likewise, a jaw contact 92 is affixed by means of a fastener 104 in the recess 36 of the base 26.

The current switch 22 includes a short circuit clip 210 having a pair of inward, resiliently biased legs forming a separable slot therebetween which receives the knife blade 86 after the knife blade 86 has been pivoted upwards, in the orientation shown in FIG. 5, out of engagement with the jaw contact 92. A U-shaped spring surrounds the short circuit clip 210 to provide inward biasing of the legs of the clip 210. A fastener 212 is insertable through the bore 44 formed in the base 26 and threadingly engages apertures formed in the base of the spring and the clip 210 to secure the short circuit clip 210 to the base 26.

A pin 214 is mounted intermediately on the knife blade 86 to act as a stop limiting upward travel of the knife blade 86 from the jaw contact 92. The pin 214 which projects outwardly from both sides of the knife blade 86 will abut the inward turned legs of the clip 210 stopping further pivotal movement of the knife blade 86.

A pin or rod, not shown, will typically be inserted between two adjacent handles 88 on two switch modules 12 for simultaneous movement of the knife blades 86 of the two adjacent current switches 22 for one phase of a three-phase service.

Figure 6:
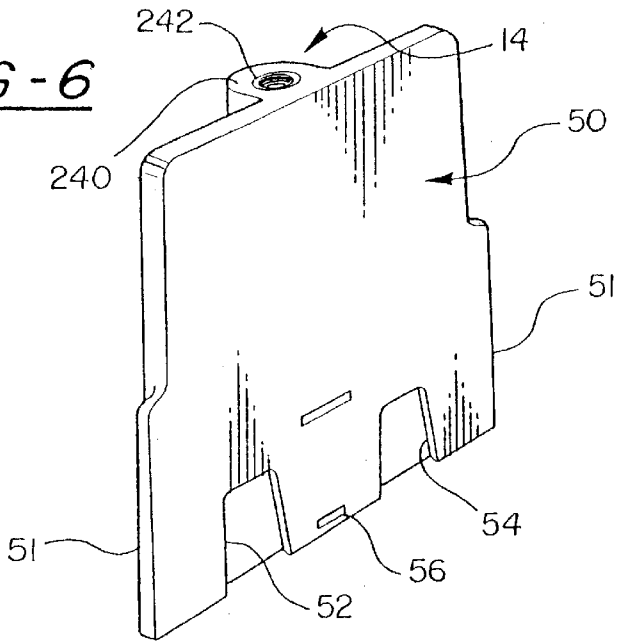
FIG. 6 is a right side perspective view of the left end piece shown in FIG. 1.

As shown in FIGS. 1, 2 and 6, the end pieces 14 and 16 include a barrier 50 identical to the barrier 50 in each of the switch modules 11, 12 and 13. A lower portion of end piece 14 includes the first pair of interconnecting members 52 and 54 as well as a lock arm receiver 56 for lockingly receiving the lock arm 64 on an adjacent switch module 12.

A tubular sleeve 240 is integrally formed with the barrier 50 and projects along the full vertical extent of the barrier 50. A threaded bore 242 is formed in the tubular sleeve 240 for receiving a threaded rod 244. As shown in FIG. 1, an upper end of the rod 244 projects exteriorly of the upper end of the tubular sleeve 240 for receiving a nut 246 to releaseably secure the cover 18 over the individual switch modules 11, 12 and 13 and the end pieces 14 and 16. As shown in FIG. 1, a pair of ribs 248 are formed on each end piece 14 and 16 for rigidity.

The end piece 16 has a base 26 integrally formed with the barrier 50 for interconnection with one switch module 13, carrying a potential switch 24.

As shown in FIG. 1, at least one bore 251 is formed between a lower leg portion of one rib 248 and the tubular sleeve 240. The bore 251 is capable of receiving a threaded fastener 252 for securing the entire test switch apparatus 10 to a support surface, such as the inner wall of a watthour meter socket.

Figure 7:
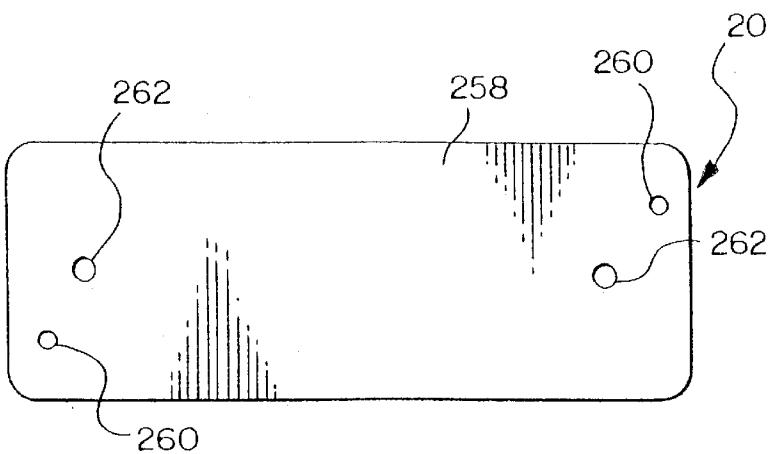
FIG. 7 is a bottom elevational view of the optional adapter plate shown in FIG. 1.

Alternately, as shown in FIGS. 1 and 7, the threaded fastener 252 may engage one of a pair of threaded bores 260 in an adapter plate 258. The adapter plate 258 generally provides a conforming hole mounting pattern to enable the test switch apparatus 10 to be mounted in a conventional existing test switch mounting hole pattern in a watthour meter socket. Thus, the adapter 258 is provided with a second pair of apertures 262 which are capable of receiving elongated fasteners to secure the adapter plate 258 and the attached test switch apparatus 10 to a support surface, such as the inner wall of a watthour meter socket.

What is claimed is:

1. A test switch apparatus comprising:

a plurality of identical modules, each having a base and a planar barrier wall integrally extending from the base, the base having a first side wall opposed from the barrier wall;

complementary interconnecting members formed on the first side wall of the base and the barrier wall for releasably interconnecting two modules in a side-by-side arrangement;

mating lock elements formed on each barrier wall and each base for lockingly interconnecting two adjacent switch modules; and a switch mountable on each base.

2. The test switch apparatus of claim 1 wherein the interconnecting members comprise:

at least one recess formed on one of the first side wall of the base and the lower portion of the barrier wall, and at least one complementary shaped projection formed on the other of the lower portion of the barrier wall and the first side wall of the base.

3. The test switch apparatus of claim 2 wherein the interconnecting elements comprise two spaced recesses and two spaced mating projections.

4. The test switch apparatus of claim 1 wherein the interconnecting members comprise:

a recess having opposed side walls extending from an open end at one edge of the base to an opposed closed end; and one projection having opposed side walls extending from one edge of the base to a central end wall.

5. The test switch apparatus of claim 1 wherein the lock elements comprises:

complementary lock elements formed on the first side wall of the base and the first portion of the barrier wall for locking two adjacent modules together.

6. The test switch apparatus of claim 1 wherein the lock elements interlock after adjacent modules are interconnected by the interconnecting members.

7. The test switch apparatus of claim 1 wherein the lock elements comprise:

a projection extending outwardly from one of the first side wall of the base and the barrier wall; and a complementary shaped recess formed in the other of the barrier wall and the first side wall of the base.

8. The test switch apparatus of claim 1 further comprising:

the interconnecting elements comprising two spaced recesses and two spaced mating projections, one lock element disposed between the two spaced recesses and one lock element disposed between the two spaced mating projections.

9. A test switch apparatus comprising:

a plurality of identical modules, each having a base and a planar barrier wall extending from the base, the base having a first side wall opposed from the barrier wall;

complementary interconnecting members formed on the first side wall of the base and the barrier wall for releasably interconnecting two modules in a side-by-side arrangement;

a switch mountable on each base;

an end piece mounted adjacent an endmost switch module, the end piece including an integral planar barrier wall and at least one interconnecting member releasably interconnectable with a mating interconnecting member on the adjacent endmost switch module; and at least one lock projection and one lock receiver formed on the end piece and releasably lockable with one complementary lock projection and one lock receiver formed on an adjacent switch module.

10. The test switch apparatus of claim 9 wherein the end piece comprises:

a base having a first side wall and an opposed barrier wall with a first portion contiguous with and extending from the base; and the one interconnecting member formed on the first side wall releasably interconnectable with the one mating interconnecting member on the barrier wall of an adjacent disposed module.

11. The test switch apparatus of claim 1 further comprising:

mating lock elements formed on each barrier wall and each base for lockingly interconnecting two adjacent switch modules.

12. The test switch apparatus of claim 11 wherein the lock elements comprises:

complementary lock elements formed on the first side wall of the base and the first portion of the barrier wall for locking two adjacent modules together.

13. The test switch apparatus of claim 11 wherein the lock elements interlock after adjacent modules are interconnected by the interconnecting members.

14. The test switch apparatus of claim 11 wherein the lock elements comprise:

a projection extending outwardly from one of the first side wall of the base and the barrier wall; and a complementary shaped recess formed in the other of the barrier wall and the first side wall of the base.

15. A test switch apparatus of comprising:

a plurality of identical modules, each having a base and a planar barrier wall extending from the base, the base having a first side wall opposed from the barrier wall;

complementary interconnecting members formed on the first side wall of the base and the barrier wall for releasably interconnecting two modules in a side-by-side arrangement;

a switch mountable on each base;

one end piece mounted to opposed ends of the plurality of identical modules;

complimentary interconnecting members formed on each of the end pieces and on each adjacent module for releasably interconnecting each end pieces to each adjacent module;

at least one lock projection and one lock receiver formed on the end piece and releasably lockable with one complementary lock projection and one lock receiver formed on an adjacent switch module;

a cover removably affixed to the end pieces; and a bore extending through end piece, the bore receiving a fastener to removably affix the cover to each end piece.

* * * * *